US007503386B2

(12) United States Patent
Rouse et al.

(10) Patent No.: US 7,503,386 B2
(45) Date of Patent: Mar. 17, 2009

(54) SLIP ON SCREEN WITH EXPANDED BASE PIPE

(75) Inventors: Bill Rouse, Montgomery, TX (US); Ken Miller, Kingwood, TX (US); Jeffrey Bode, The Woodlands, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 11/760,805

(22) Filed: Jun. 11, 2007

(65) Prior Publication Data

US 2007/0227726 A1 Oct. 4, 2007

Related U.S. Application Data

(62) Division of application No. 10/985,503, filed on Nov. 10, 2004, now Pat. No. 7,249,631.

(51) Int. Cl.
*E21B 43/08* (2006.01)

(52) U.S. Cl. ..... 166/227; 166/207; 166/230; 166/233

(58) Field of Classification Search ..... 166/227, 166/230, 233, 207
See application file for complete search history.

(56) References Cited

U.S. PATENT DOCUMENTS

| | | | | |
|---|---|---|---|---|
| 2,081,190 | A * | 5/1937 | Wilson | 166/233 |
| 3,275,785 | A | 9/1966 | Wilson | |
| 3,469,609 | A | 9/1969 | Smith, III | |
| 4,314,129 | A | 2/1982 | Wilson et al. | |
| 4,487,259 | A * | 12/1984 | McMichael, Jr. | 166/228 |
| 5,738,170 | A * | 4/1998 | Lavernhe | 166/228 |
| 5,909,773 | A | 6/1999 | Koehler et al. | |
| 6,352,111 | B1 | 3/2002 | Bode et al. | |
| 6,371,210 | B1 | 4/2002 | Bode et al. | |
| 6,457,518 | B1 | 10/2002 | Castano-Mears et al. | |
| 6,510,896 | B2 | 1/2003 | Bode et al. | |
| 6,571,871 | B2 | 6/2003 | Lauritzen et al. | |
| 6,612,481 | B2 | 9/2003 | Bode | |
| 6,644,412 | B2 | 11/2003 | Bode et al. | |

(Continued)

FOREIGN PATENT DOCUMENTS

| | | |
|---|---|---|
| GB | 2 042 390 | 9/1980 |

(Continued)

OTHER PUBLICATIONS

Canadian Office Action, Application No. 2,526,024, dated Sep. 25, 2007.

*Primary Examiner*—Giovanna C Wright
(74) *Attorney, Agent, or Firm*—Patterson & Sheridan, L.L.P.

(57) ABSTRACT

A method for manufacturing a wellscreen and a wellscreen that have the mechanical properties of a direct-wrap wellscreen and the precise slot tolerance of a slip-on wellscreen are provided. In one embodiment, a method for manufacturing a wellscreen for use in a wellbore is provided. The method includes disposing a filter subassembly on a base pipe sized so that there is annulus between the base pipe and the filter subassembly. The filter subassembly includes a length of wire wrapped and welded along a plurality of rods so that a slot is defined between adjacent coils of wire. The method further includes expanding the base pipe so that the slot is not substantially altered, thereby substantially reducing or eliminating the annulus.

14 Claims, 7 Drawing Sheets

U.S. PATENT DOCUMENTS

| | | | |
|---|---|---|---|
| 6,698,518 | B2 | 3/2004 | Royer et al. |
| 6,715,544 | B2 | 4/2004 | Gillespie et al. |
| 6,722,443 | B1 | 4/2004 | Metcalfe |
| 6,742,586 | B2 | 6/2004 | Lauritzen et al. |
| 6,742,598 | B2 | 6/2004 | Whitelaw et al. |
| 6,749,023 | B2 | 6/2004 | Nguyen et al. |
| 6,789,621 | B2 | 9/2004 | Wetzel et al. |
| 6,832,649 | B2 | 12/2004 | Bode et al. |
| 6,868,905 | B2 | 3/2005 | Lauritzen et al. |
| 6,883,613 | B2 | 4/2005 | Bode et al. |
| 7,048,061 | B2 | 5/2006 | Bode |
| 7,102,745 | B2 | 9/2006 | Rouse et al. |
| 2002/0125008 | A1 | 9/2002 | Wetzel et al. |
| 2002/0189808 | A1 | 12/2002 | Nguyen et al. |
| 2005/0034860 | A1 | 2/2005 | Lauritzen |
| 2005/0086807 | A1 * | 4/2005 | Richard et al. ..... 29/896.61 |

FOREIGN PATENT DOCUMENTS

| | | |
|---|---|---|
| WO | WO 2005/045187 | 5/2005 |
| WO | WO 2005/061851 | 7/2005 |

* cited by examiner

SLIP ON SCREEN WITH EXPANDED BASE PIPE

CROSS-REFERENCE TO RELATED APPLICATIONS

This application is a divisional of U.S. patent application Ser. No. 10/985,503, filed Nov. 10, 2004, now U.S. Pat. No. 7,249,631 which is herein incorporated by reference in its entirety.

BACKGROUND OF THE INVENTION

1. Field of the Invention

Embodiments of the present invention generally relate to a wellscreen, more particularly, to a slip-on screen with an expanded base pipe.

2. Description of the Related Art

The problem of reliably removing particulates from liquids or gasses (production fluids) exists in many types of wells including oil and gas wells, water wells, geothermal wells, and wells for ground remediation. Typical particulates needing to be filtered out are sand and clay including unconsolidated particulate matter, also known as "formation sand". A major problem in producing hydrocarbon fluids from unconsolidated formations is the intrusion of formation sand, which is typically very fine, into production fluid and equipment. The presence of sand in production fluid often leads to the rapid erosion of expensive well machinery and hardware.

Subterranean filters, also known as "sand screens" or "wellscreens", have been used in the petroleum industry for years to remove particulates from production fluids. They are generally tubular in shape, comprising a perforated inner member or pipe, at least one porous filter layer wrapped around and secured to the pipe, and an outer cover. The wellscreens are used where fluid enters a production string. For example, a common way to achieve the filtration is to mount a wellscreen in the production string near the area of fluid production such that the produced fluid must pass through the filter layers and into the perforated pipe prior to entering the production string and being pumped to the surface.

One type of filter is a screen manufactured from wrapped wire. Two typical types of wire wrap screens are slip-on screens and direct-wrap screens. A slip-on screen is manufactured by wrapping a screen jacket on a precisely machined mandrel. Then the jacket is later slipped on the base pipe and the end of the jacket is attached to the base pipe. The slip-on screen allows for precise slots to be constructed, but is inherently weaker than direct-wrap screen because of an annulus between the screen jacket and the base pipe. Differential pressure usually exists across the screen when in service. This pressure, if sufficient, will cause the wires and the rods to be bent inwardly into contact with the base pipe. Such a collapse will result in a shifting of the coils of wire forming the screen and reduce or destroy the ability of the screen to serve its intended purpose.

The direct-wrap screen is constructed by wrapping the screen directly on the perforated base pipe, resulting in a stronger screen by eliminating the annulus between the screen jacket and the base pipe. Variations in the base pipe, however, result in a less precise screen slots.

Therefore, there exists in the art a need for a wellscreen that has the mechanical properties of a direct-wrap wellscreen and the precise slot tolerance of a slip-on wellscreen.

FIG. 1 is a view partly in elevation and partly in section of a prior art method and apparatus for forming a welded rod-based screen in place on a mandrel 10. A plurality of rods 12 extend along the outside surface of the precisely-machined mandrel 10, generally parallel to its longitudinal axis. The rods 12 are usually equally spaced around the outside of the mandrel 10. Wire 14 is shown being wrapped around the mandrel 10 and rods 12 to form a screen. The wire feeding means is not shown but is of conventional construction usually comprising a drum from which the wire is fed. Usually, some sort of braking arrangement is used to hold the wire in tension to cause it to bend around the pipe and the rods. For examples of wire feeding means, see U.S. Pat. No. 3,275,785, entitled "Method and Apparatus for Manufacturing Well Screens", which issued to Hill D. Wilson on Sep. 27, 1966 and U.S. Pat. No. 3,469,609, which issued Sep. 30, 1969 to Howard L. Smith, III.

To wrap the wire 14 on the mandrel 10 and rods 12, relative rotation between the mandrel and rods and the wire feeding means is necessary. Usually, the wire feeding means is fixed and the mandrel 10 and rods 12 are rotated. At the same time the mandrel 10 and rods 12 are moved longitudinally at a speed which along with the speed of rotation provides the desired spacing between the adjacent coils of wire 14. This spacing is commonly referred to as the "slot". Alternatively, as shown in the Smith Patent, the wire feeding means can be moved longitudinally of the pipe and rods while the pipe and rods are rotated.

Welding electrode 16 is positioned to engage the wire 14 as it is wrapped on the mandrel 10 and provide a welding current that causes the wire and the rod it engages to fuse together. The welding electrode 16 is disc-shaped and rolls along the wire 14. To complete the circuit, means are provided to connect the rods 12 to ground a short distance ahead of the wrapped wire 14.

In FIG. 1, such means comprise ground electrode assembly 18. The ground electrode assembly 18 includes a plurality of contact assemblies 20 and a mounting plate 28. Each contact assembly 20 includes contact 22 and contact housing 24, as shown in FIG. 3. The contact 22 is generally L-shaped having leg 22*a* which extends outwardly from housing 24 and leg 22*b*, which is generally located within U shaped housing 24. Leg 22*a* has an elongated contact surface 22*c* for engaging one of the rods 12 that extends along the surface of the mandrel 10. Preferably, contact surface 22*c* is provided with groove 26 extending parallel to the rod 12 to receive the rod and to guide the rod as it moves from under the contact to a position under the wire 14 and the welding electrode 16. Each individual contact assembly 20 is attached to the mounting plate 28 as shown in FIGS. 1 and 2 along a line extending radially from the center of the mandrel 10. Each contact 22 engages one of the rods 12 located on the outside of the mandrel 10.

Means are provided to resiliently urge the contact surface 22*c* of each contact 22 toward the rod 12 it engages to hold the rod in contact with the mandrel 10. In the embodiment shown, coil spring 30 is positioned between the back of U-shaped housing 24 and engages leg 22*b* adjacent its upper end. The spring urges the contact 22 to pivot around pin 32, which mounts the contact in the housing 24. This in turn urges contact surface 22*c* of the contact 22 into firm engagement with the rod 12 it engages and, in turn, holds the rod in groove 26 and against the outside surface of mandrel 10. As the mandrel 10 and rods 12 are rotated, the rods tend to move and flop around. So the contacts 22 through the resilient force of springs 30 and grooves 26 also serve to hold the rods 12 from lateral movement and guide the rods as they move under the wire 14 and welding electrode 16 so that they will have the proper spacing under the wire.

Ground electrode assembly 18 including contacts 22 should be made of a material having good electrical conductivity, such as brass. This reduces the tendency for any welding to occur between the contacts 22 and the rods 12. The rods 12 are generally made of steel, often stainless steel. Housing 24 for the contact assembly 20 as well as the mounting plate 28 should also be made of a material having good electrical conductivity. The ground electrode assembly 18 is mounted for rotation with the mandrel 10 and the rods 12. A commutator or the like (not shown) connects the ground electrode assembly 18 to ground.

The best welds are obtained between the wire 14 and the rod 12 by providing an electrical welding circuit wherein the major resistance in the circuit is the contact between the wire and the rod to which it is to be welded. The circuit between there and ground should be substantially lower in resistance. Therefore, ground electrode assembly 18 is preferably positioned so that contact surface 22*c* on each individual contact 22 is positioned as close to the welding electrode as possible to reduce the distance the electrical current has to flow down the rod to the ground contact. Also, the contacts 22 can do a better job of guiding the rods 12, the closer the contacts are to the point of welding the wire to the rods. Preferably, the contacts 22 are spaced less than one inch from the welding electrode.

Mounted on the back of mounting plate 28 of the ground electrode assembly 18 are means for engaging the outside surface of the mandrel 10 to hold the contacts 22 of the ground electrode 18 equally spaced from the longitudinal axis of the pipe. In the embodiment shown, four wheels 36 are positioned at 90 degree angles from each other to extend between the rods and engage the surface of the mandrel 10. These wheels 36 serve to hold the individual contacts 22 of the ground electrode assembly 18 equally spaced from the mandrel 10, i.e. the electrode is centered relative to the mandrel.

FIG. 4 is an exploded view of an exemplary expansion tool 100. The expansion tool 100 has a body 102 which is hollow and generally tubular with connectors 104 and 106 for connection to other components (not shown) of a downhole assembly. The connectors 104 and 106 are of a reduced diameter compared to the outside diameter of the longitudinally central body part of the tool 100. The central body part has three recesses 114, each to hold a respective roller 116. Each of the recesses 114 has parallel sides and extends radially from a radially perforated tubular core (not shown) of the tool 100. Each of the mutually identical rollers 116 is somewhat cylindrical and barreled. Each of the rollers 116 is mounted by means of an axle 118 at each end of the respective roller and the axles are mounted in slidable pistons 120. The rollers are arranged for rotation about a respective rotational axis that is parallel to the longitudinal axis of the tool 100 and radially offset therefrom at 120-degree mutual circumferential separations around the central body 102. The axles 118 are formed as integral end members of the rollers and the pistons 120 are radially slidable, one piston 120 being slidably sealed within each radially extended recess 114. The inner end of each piston 120 is exposed to the pressure of fluid within the hollow core of the tool 100 by way of the radial perforations in the tubular core. In this manner, pressurized fluid provided from the surface of the well, via a tubular, can actuate the pistons 120 and cause them to extend outward whereby the rollers 116 contact the inner wall of a tubular to be expanded.

SUMMARY OF THE INVENTION

The present invention provides a method for manufacturing a wellscreen and a wellscreen that have the mechanical properties of a direct-wrap wellscreen and the precise slot tolerance of a slip-on wellscreen.

In one embodiment, a method for manufacturing a wellscreen for use in a wellbore is provided. The method includes disposing a filter subassembly on a base pipe sized so that there is annulus between the base pipe and the filter subassembly. The filter subassembly includes a length of wire wrapped and welded along a plurality of rods so that a slot is defined between adjacent coils of wire. The method further includes expanding the base pipe so that the slot is not substantially altered, thereby substantially reducing or eliminating the annulus.

In another embodiment, a wellscreen for use in a wellbore is manufactured by a method. The method includes disposing a filter subassembly on a base pipe sized so that there is annulus between the base pipe and the filter subassembly. The filter subassembly includes a length of wire wrapped and welded along a plurality of rods so that a slot is defined between adjacent coils of wire. The method further includes expanding the base pipe so that the slot is not substantially altered, thereby substantially reducing or eliminating the annulus.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

FIG. 5A is a section view of a wellscreen during a first assembly step. FIG. 5B is a section view of a wellscreen during an expansion step. FIG. 5C is a section view of a completed wellscreen.

FIG. 6A is a section view of the wellscreen after run-in and before expansion of the base pipe. FIG. 6B is a section view illustrating the wellbore and the wellscreen partially expanded therein.

DETAILED DESCRIPTION

Figure 1:
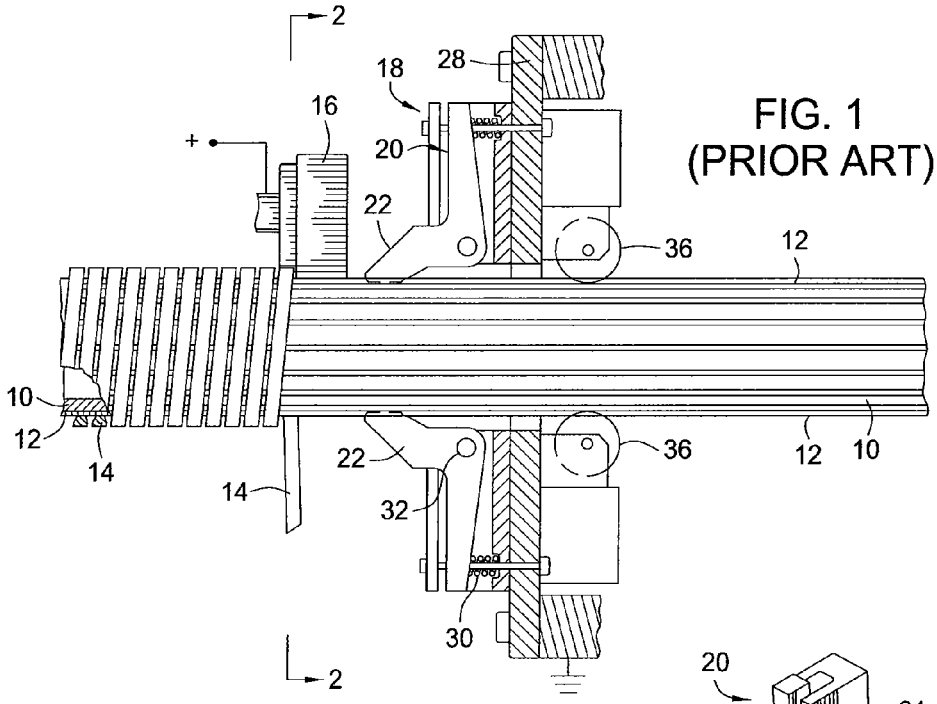
FIG. 1 (PRIOR ART)
FIG. 1 is a view partly in elevation and partly in section of a prior art method and apparatus for forming a welded rod-based screen in place on a mandrel.
Figure 3:
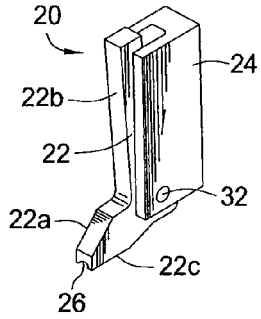
FIG. 3 (PRIOR ART)
FIG. 3 is an isometric view of one of the contact assemblies of the ground electrode.
Figure 2:
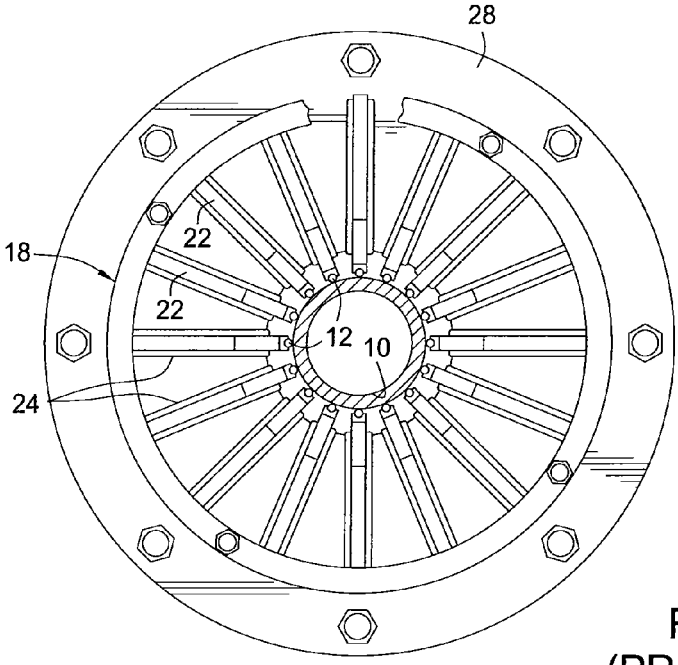
FIG. 2 (PRIOR ART)
FIG. 2 is a cross sectional view taken along line 2-2 of FIG. 1.
Figure 4:
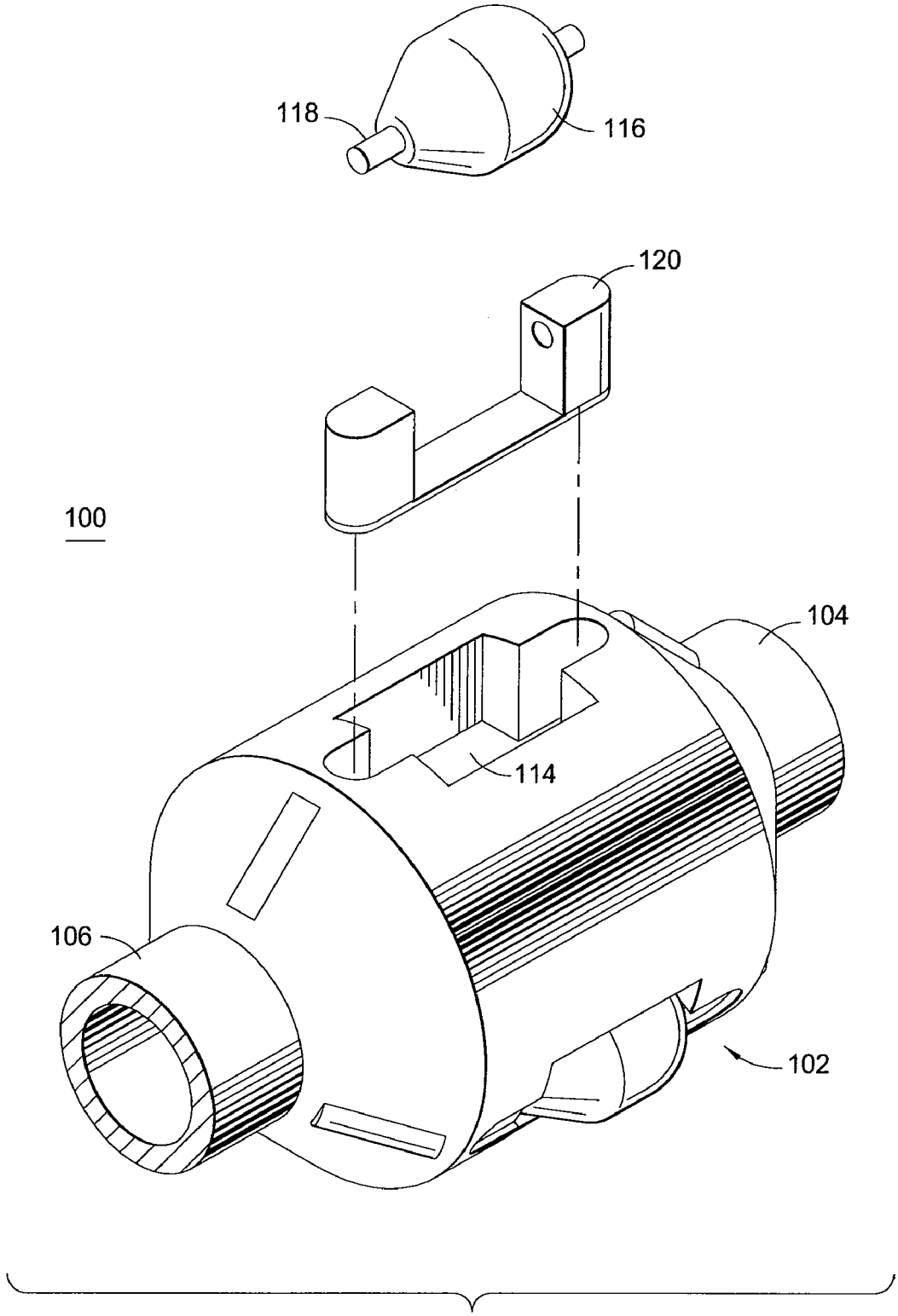
FIG. 4 (PRIOR ART)
FIG. 4 is an exploded view of an exemplary expansion tool.
Figure 5A:
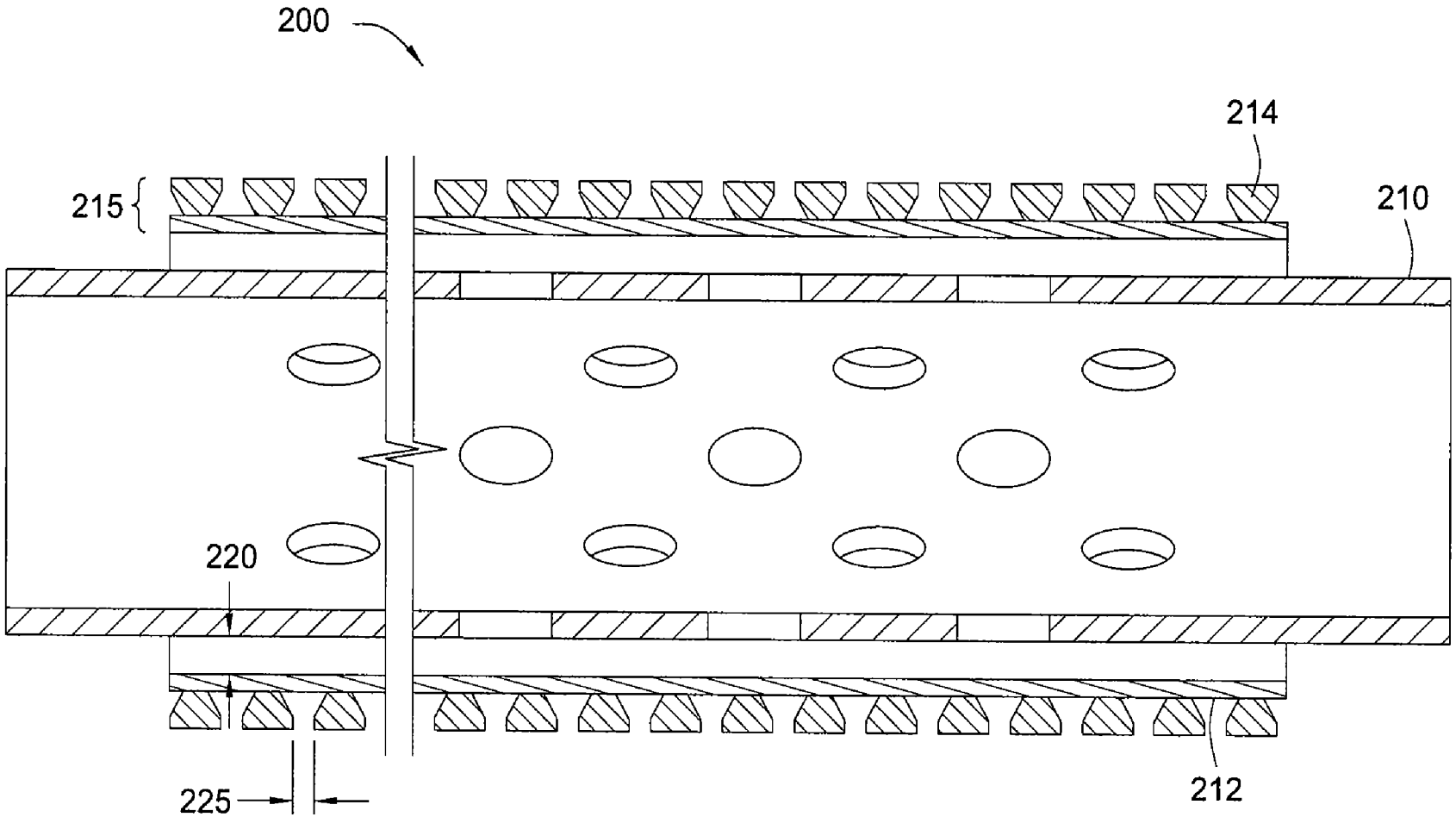
FIGS. 5A-5C are section views of assembly steps for a wellscreen according to one embodiment of the present invention.
Figure 5B:
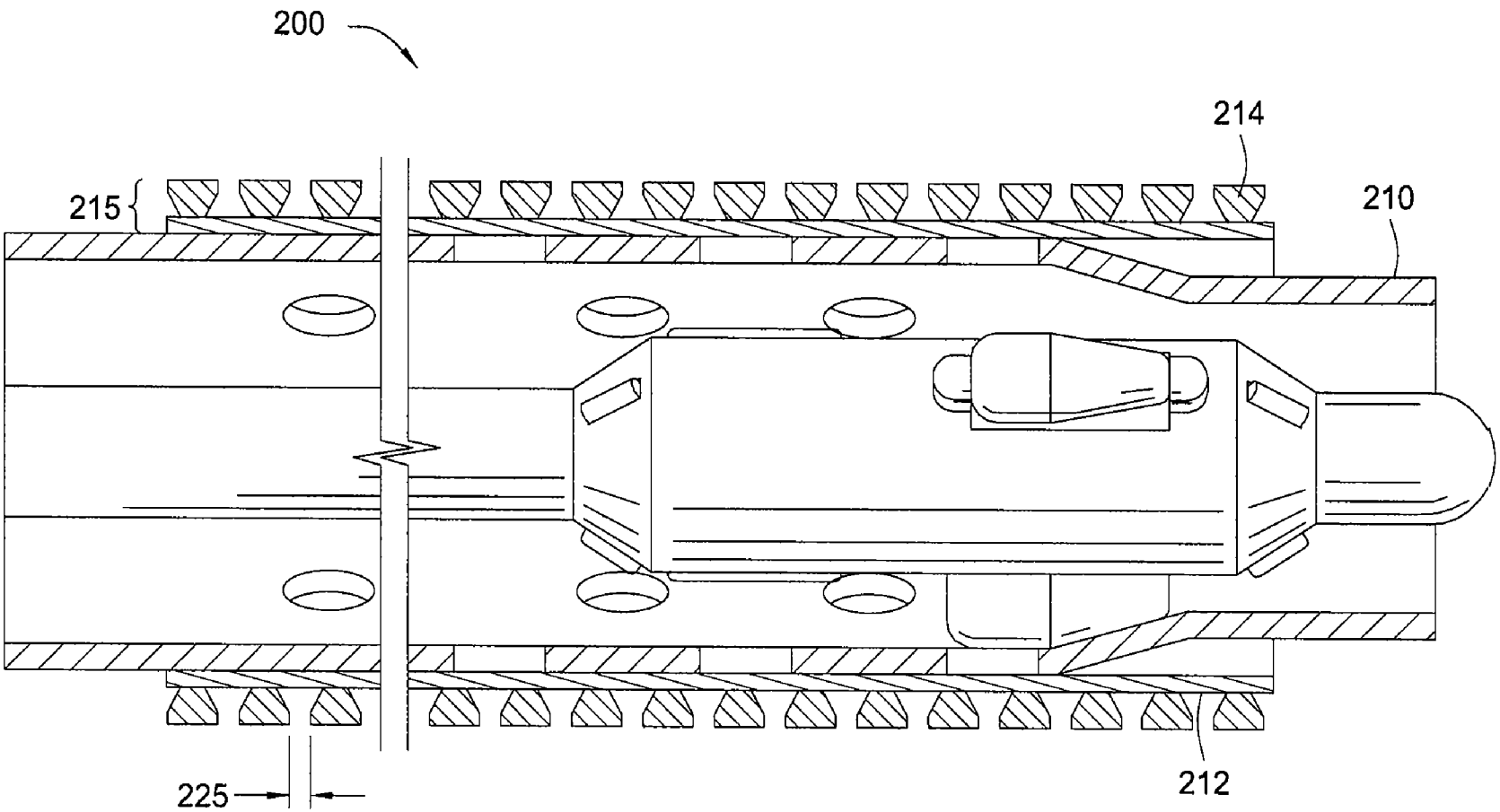
Figure 5C:
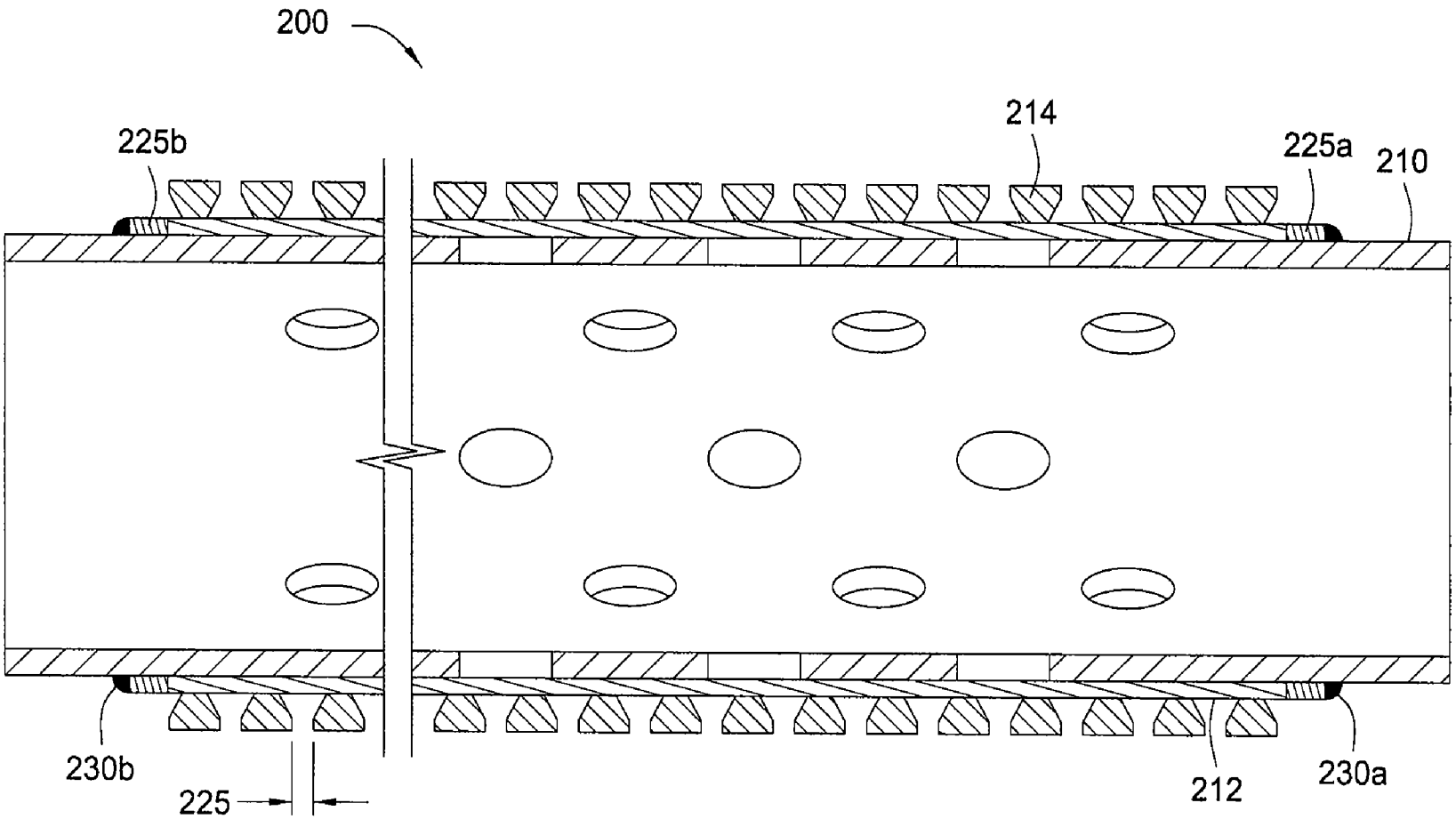

FIGS. 5A-5C are section views of assembly steps for a wellscreen 200 according to one embodiment of the present invention. FIG. 5A is a section view of a wellscreen 200 during a first assembly step. The wellscreen 200 comprises a filter subassembly 215 and a perforated base pipe 210. Alternatively, the base pipe may be slotted. The filter subassembly 215 is manufactured according to a process described above with respect to FIGS. 1-3. As such, the filter subassembly comprises a length of wire 214 wrapped and welded along a plurality of rods 212. Manufacturing the filter subassembly 215 on a precisely machined mandrel 10 ensures better control over a slot 225, which is the distance between adjacent coils of wire 214, than manufacturing the filter subassembly directly on the base pipe 210.

After manufacture, the filter subassembly 215 is removed from the mandrel 10 and disposed on the perforated base pipe 210. The base pipe 210 is sized so that there is an annulus 220 between the base pipe 210 and the filter subassembly 220. The filter subassembly 215 may be temporarily coupled to the base pipe 210 so that the filter subassembly does not move longitudinally or radially relative to the base pipe prior to expansion of the base pipe. The base pipe 210 may then be placed in a press (not shown) where a first end would be supported for expansion and a second end would receive the expansion tool 100.

FIG. 5B is a section view of the wellscreen 200 during an expansion step. As shown in the figure, the expansion tool 100 has been activated with its rollers 116 contacting the inner wall of base pipe 210 and applying an outward radial force thereto. Radial force applied to the inner wall of the base pipe 210 is forcing the base pipe past its elastic limits, thereby substantially reducing or eliminating the annulus 220. Preferably, the annulus 220 is eliminated during expansion, thereby placing the base pipe 210 into contact with the rods 212, possibly even slightly expanding the filter subassembly 215. However, the expansion tool 100 is configured or controlled so that the base pipe 210 is expanded without substantially expanding the filter subassembly 215. Substantial expansion of filter subassembly 215 could substantially alter the size of the slot 225. On the other hand, substantial under-expansion of the base pipe 210 could result in inadequate support of the filter subassembly 215. In alternate aspects, other types of expansion tools, such as a cone-type expansion tool which is longitudinally driven, may be used to expand the base pipe 210 instead of the rotary-type expansion tool 100. Preferably, the base pipe 210 is expanded on the surface, however, as discussed below the base pipe may be expanded in a wellbore.

FIG. 5C is a section view of the completed wellscreen 200. After expansion, end rings 225*a,b* are disposed on the base pipe 210, each adjacent to a respective end of the rods 212. The end rings 225*a,b* are each secured to the base pipe 210 with a respective one of welds 230*a,b*. The resulting wellscreen 200 has the mechanical properties of a direct-wrap wellscreen and the precise slot tolerance of a slip-on wellscreen. Optionally, a perforated shroud (not shown) may then be coupled to the base pipe 210 over the filter subassembly 215 to provide protection to the filter subassembly for downhole use.

Figure 6A:
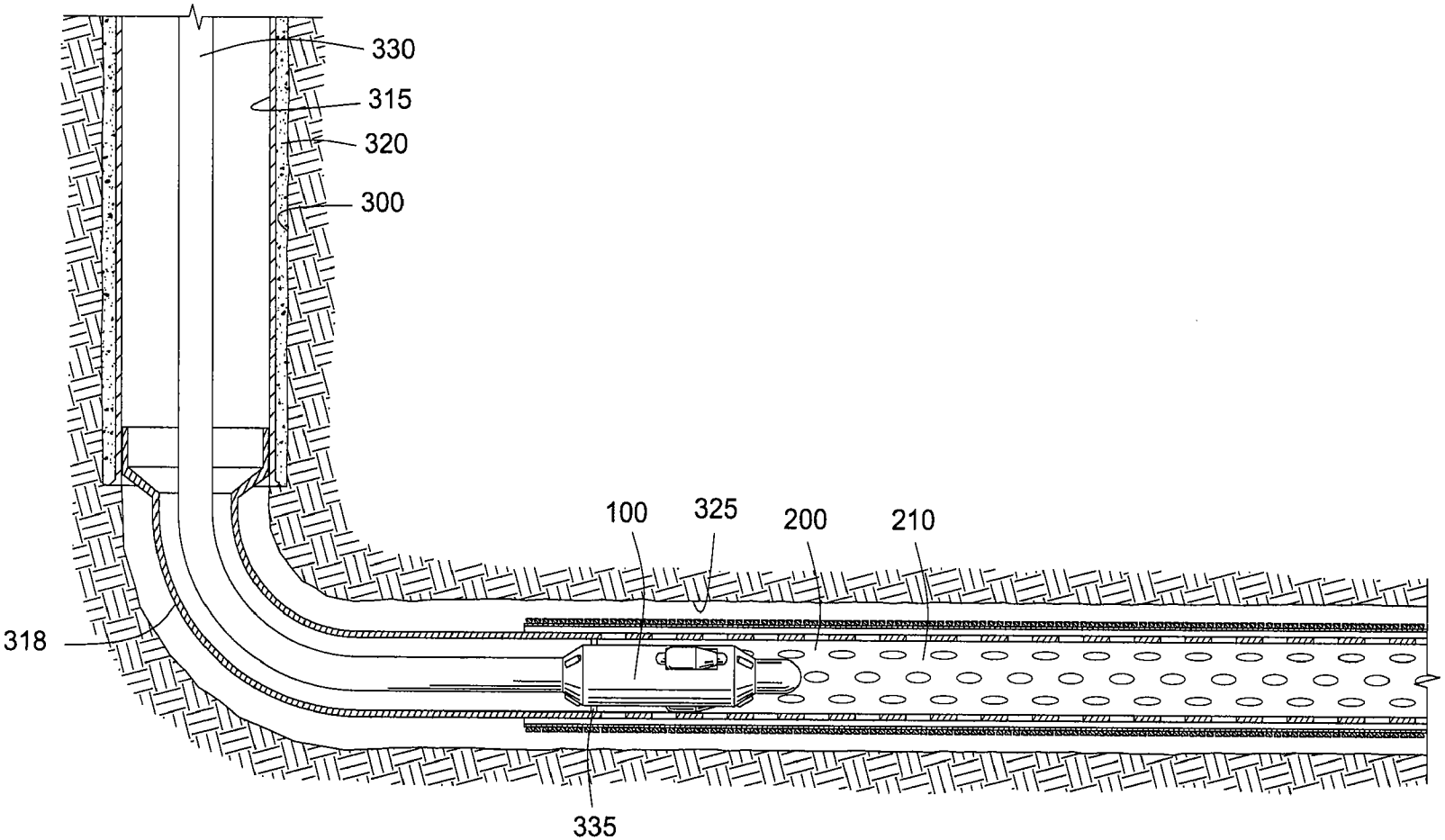
FIGS. 6A-6B are section views of the wellscreen disposed in a wellbore according to an alternative embodiment of the present invention.
Figure 6B:
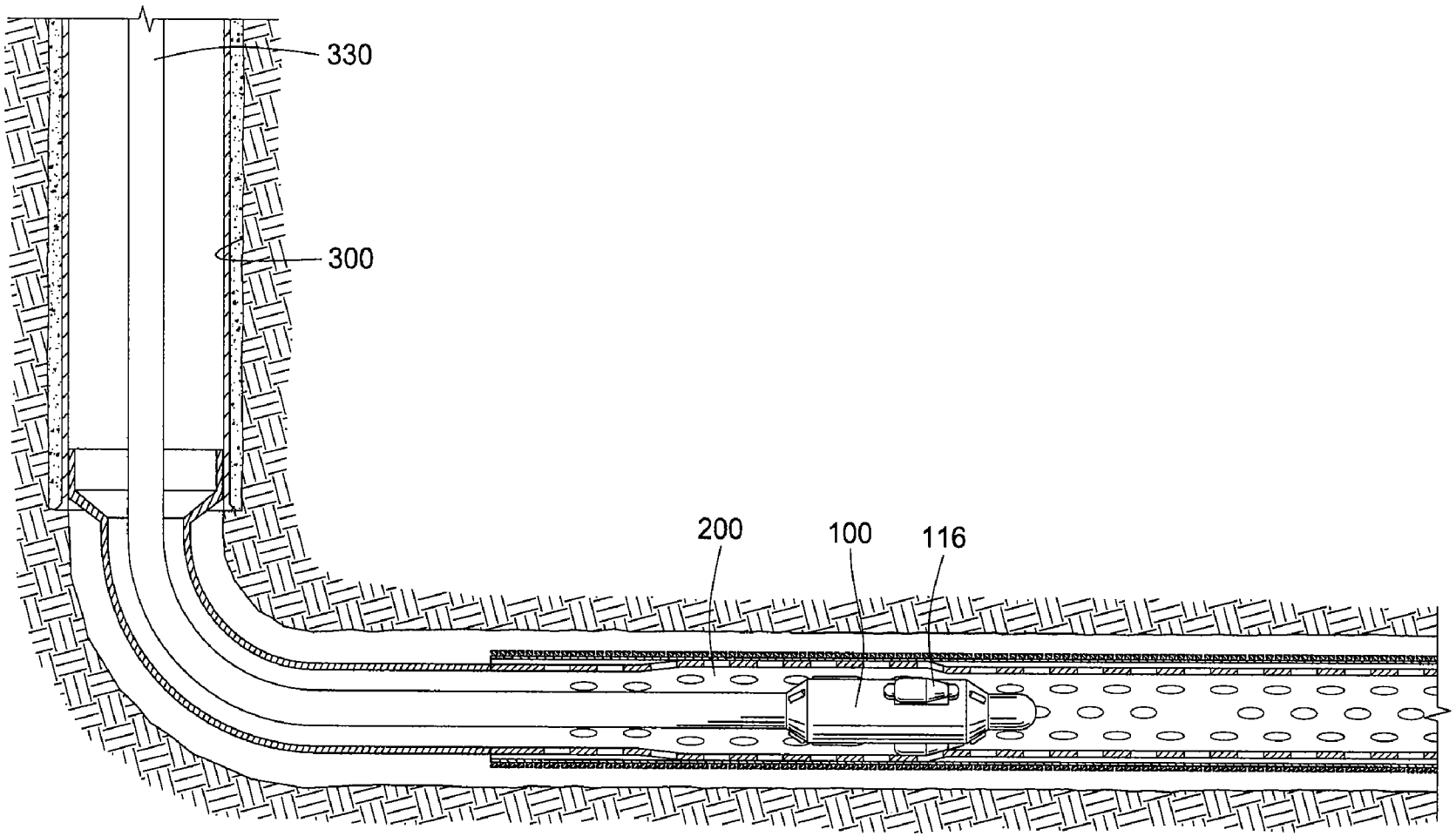

FIGS. 6A-6B are section views of the wellscreen 200 disposed in a wellbore 300 according to an alternative embodiment of the present invention. FIG. 6A is a section view of the wellscreen 200 after run-in and before expansion of the base pipe 210. The wellbore 300 includes a central wellbore which is lined with casing 315. The annular area between the casing and the earth is filled with cement 320 as is typical in well completion. Extending from the central wellbore is an open, horizontal wellbore 325. Disposed in the open wellbore 325 is the wellscreen 200. As illustrated in FIG. 6A, the wellscreen 200 is run into the wellbore on a tubular run-in string 330. Disposed at the end of the run-in string is the expander tool 100. In the embodiment shown, the expander tool 100 is initially fixed to the wellscreen 200 with a temporary connection 335 like a shearable connection or some other temporary mechanical means. The filter subassembly 215 is also fixed to the base pipe 210 with a temporary connection (not shown). Typically, the wellscreen 200 is located at the lower end of a liner 318 which is run into the well and hung from the lower portion of the casing 315 by some conventional slip means. Below the liner top, the outer diameter of the liner 318 is reduced to a diameter essentially equal to the diameter of the wellscreen 200.

FIG. 6B is a section view illustrating the wellbore 300 and the wellscreen 200 partially expanded therein. As shown in the figure, the expansion tool 100 has been activated with its rollers 116 contacting the inner wall of base pipe 210 and applying an outward radial force thereto. Typically, the temporary connection 335 between the expander tool 100 and the wellscreen 200 are disengaged as the expander tool is actuated and thereafter, the expander tool moves independently of the wellscreen 200 to expand the base pipe 210 as discussed above with reference to FIG. 5B.

While the foregoing is directed to embodiments of the present invention, other and further embodiments of the invention may be devised without departing from the basic scope thereof, and the scope thereof is determined by the claims that follow.

The invention claimed is:

1. A wellscreen for use in a wellbore, comprising:
a filter subassembly comprising a length of wire wrapped and welded along a plurality of rods so that a slot is defined between adjacent coils of wire; and
a base pipe,
wherein:
the filter subassembly is disposed on the base pipe so that the rods are in contact with an outer surface of the base pipe,
each slot is precisely uniform,
the rods have longitudinal ends,
the wellscreen further comprises a ring disposed adjacent each end of the rods, and
each of the rings is welded to the outer surface of the base pipe.

2. The wellscreen of claim 1, wherein the base pipe is perforated.

3. The wellscreen of claim 1, wherein the slot is sized to remove sand from hydrocarbon fluid.

4. The wellscreen of claim 1, wherein the base pipe is plastically expanded.

5. A wellscreen for use in a wellbore, manufactured by a method, the method comprising:
disposing a filter subassembly on a base pipe sized so that there is annulus between the base pipe and the filter subassembly, the filter subassembly comprising a length of wire wrapped and welded along a plurality of rods so that a slot is defined between adjacent coils of wire, wherein each slot is precisely uniform; and
expanding the base pipe into contact with the rods without substantially expanding the filter subassembly so that the slot is not substantially altered, thereby eliminating the annulus,
wherein:
the rods have longitudinal ends, and
the method further comprises:
disposing a ring adjacent each end of the rods, and
welding each of the rings is to the outer surface of the base pipe.

6. The wellscreen of claim 5, wherein the base pipe is expanded on the surface.

7. The wellscreen of claim 5, wherein the base pipe is expanded in the wellbore.

8. The wellscreen of claim 5, wherein the base pipe is expanded with a rotary-type expander tool.

9. The wellscreen of claim 5, wherein the base pipe is plastically expanded.

10. The wellscreen of claim 5, wherein the method further comprises wrapping the length of wire on the plurality of rods, wherein the wire is welded to the rods as the wire is being wrapped.

11. The wellscreen of claim 10, wherein the rods are disposed along a precisely machined mandrel when the wire is wrapped and welded along the rods.

12. The wellscreen of claim 5, wherein the base pipe is expanded without any expansion of the filter subassembly.

13. The wellscreen of claim 5, wherein the slot is sized to remove sand from hydrocarbon fluid.

14. The wellscreen of claim 5, wherein the base pipe is perforated.

* * * * *